US011083659B1

(12) United States Patent
Grismer et al.

(10) Patent No.: US 11,083,659 B1
(45) Date of Patent: Aug. 10, 2021

(54) EPIDURAL PATIENT POSITIONING SYSTEM

(71) Applicant: Pivotal Health Solutions, Inc., Watertown, SD (US)

(72) Inventors: Quentin Grismer, Watertown, SD (US); Eric Tilberg, Watertown, SD (US)

(73) Assignee: Pivotal Health Solutions, Inc., Watertown, SD (US)

( * ) Notice: Subject to any disclaimer, the term of this patent is extended or adjusted under 35 U.S.C. 154(b) by 0 days.

(21) Appl. No.: 14/051,099

(22) Filed: Oct. 10, 2013

(51) Int. Cl.
*A61G 15/02* (2006.01)
*A61G 15/00* (2006.01)
*A61G 15/12* (2006.01)

(52) U.S. Cl.
CPC ..... *A61G 15/02* (2013.01); *A61G 15/002* (2013.01); *A61G 15/125* (2013.01); *A61G 2210/00* (2013.01)

(58) Field of Classification Search
CPC .... A61G 15/00; A61G 15/002; A61G 15/005; A61G 15/007; A61G 15/02; A61G 15/08; A61G 15/10; A61G 15/12; A61G 15/125; A61G 13/0009; A61G 13/0019; A61G 13/0036; A61G 13/0054; A61G 13/009; A61G 13/02; A61G 13/08; A61G 13/12; A61G 13/1235; A61G 13/125; A61G 2200/34; A47C 7/50; A47C 7/506; A47C 9/025; A47C 3/00; A47C 7/54; A47C 16/00; A47C 16/005; A47C 16/02; A47C 7/40; A47C 7/503; A47C 7/541; A61B 90/60; A61M 37/0076
USPC ..... 128/845; 297/423.11
See application file for complete search history.

(56) References Cited

U.S. PATENT DOCUMENTS 3,894,601 A * 7/1975 Gestring ..... A61B 90/60 180/214
4,239,282 A * 12/1980 White ..... B64D 11/0689 297/284.1
4,943,117 A 7/1990 Brown
5,295,728 A * 3/1994 Schaevitz ..... A47C 9/025 297/195.1
5,971,485 A * 10/1999 Clark ..... A61G 13/009 297/195.11
6,182,663 B1 * 2/2001 Madden ..... A61G 15/00 128/845
6,543,853 B1 * 4/2003 Splane, Jr. ..... A47C 9/005 297/195.11
6,758,447 B2 * 7/2004 Tinsley ..... A61G 13/12 248/118

(Continued)

*Primary Examiner* — Victoria J Hicks
*Assistant Examiner* — Kevin S Albers
(74) *Attorney, Agent, or Firm* — Jeffrey A. Proehl; Woods, Fuller, Shultz & Smith, PC

(57) ABSTRACT

An epidural patient positioning system for providing a mobile support platform which is adjustable for a wide range of patient sizes and configurations of treatment tables. The epidural patient positioning system includes a base assembly having a plurality of casters, a vertical assembly extending upwardly from the base assembly, a pair of adjustable foot supports positioned on either side of the vertical assembly, and pair of adjustable arm supports positioned on either side of the vertical assembly, a torso support member positionable both vertically and laterally rom the vertical assembly, and a motor and control assembly.

1 Claim, 5 Drawing Sheets

(56) References Cited

U.S. PATENT DOCUMENTS

| | | | | |
|---|---|---|---|---|
| 7,603,730 | B2 | 10/2009 | Zelnik | |
| 8,365,739 | B1 * | 2/2013 | Jones | A61G 13/122 128/845 |
| 8,371,305 | B1 * | 2/2013 | Perper | A61G 15/02 128/845 |
| 10,517,404 | B2 * | 12/2019 | Hopper | A47C 7/543 |
| 2003/0011228 | A1 * | 1/2003 | Komura | A61G 5/14 297/344.12 |
| 2003/0090132 | A1 * | 5/2003 | Dixon | A61G 7/065 297/195.11 |
| 2006/0207021 | A1 * | 9/2006 | Brunson | A61B 90/60 5/81.1 R |
| 2009/0069161 | A1 * | 3/2009 | Caldwell | A63B 23/12 482/138 |
| 2010/0295357 | A1 * | 11/2010 | Koehler | A61G 15/08 297/411.2 |
| 2011/0127391 | A1 * | 6/2011 | McDonald | A47C 7/38 248/118 |
| 2014/0035246 | A1 * | 2/2014 | Plotnizky | A61G 5/12 280/87.01 |
| 2014/0259419 | A1 * | 9/2014 | Stusynski | A61G 7/015 5/618 |
| 2014/0265496 | A1 * | 9/2014 | Magelund | A61B 90/60 297/313 |
| 2015/0123450 | A1 * | 5/2015 | Miller | A47C 16/00 297/488 |

* cited by examiner

EPIDURAL PATIENT POSITIONING SYSTEM

GOVERNMENT SUPPORT

Not Applicable

BACKGROUND OF THE INVENTION

Field of the Invention

The present invention relates to patient positioning and stabilizing devices and more particularly pertains to a new epidural patient positioning system for providing an adjustable stable platform for supporting patients in position to receive epidural treatment.

Epidural anesthesia or analgesia is a commonly used regional anesthetic procedure used for surgical, obstetric, postoperative treatments as well as for the treatment of chronic back pain. Often, especially when a sitting position is required, the patient is not able to either position themselves or once positioned to support themselves for the duration of the procedure. Commonly, a healthcare worker, such as a nurse, supports the patient during the procedure, increasing the potential for injury of the patient as well as the healthcare worker. The present invention provides a mobile system which may be configured to support patients with a wide range of heights and including those positioned on tables of varying heights.

Description of the Prior Art

The use of patient positioning and stabilizing devices is known in the prior art. More specifically, patient positioning and stabilizing devices heretofore devised and utilized are known to consist basically of familiar, expected and obvious structural configurations, notwithstanding the myriad of designs encompassed by the crowded prior art which have been developed for the fulfillment of countless objectives and requirements.

Many such devices are adapted to be clamped or otherwise secured onto other structures, have limited adjustability, or require medical personnel to actively support the patient, which can lead to injury of not only the patient, but also the medical personnel providing support.

Illustrative examples of the prior art include U.S. Pat. Nos. 6,758,447; 7,603,730; and 4,943,117.

In these respects, the epidural patient positioning system according to the present invention substantially departs from the conventional concepts and designs of the prior art, and in so doing provides an apparatus primarily developed for the purpose of providing a highly mobile and stable means of supporting a patient for epidural treatment which can be adjusted for a wide variety of patient sizes and treatment table configurations.

SUMMARY OF THE INVENTION

In view of the foregoing disadvantages inherent in the known types of patient positioning and support devices now present in the prior art, the present invention provides a new epidural patient positioning system construction wherein the same can be utilized for providing a highly mobile and stable means of supporting a patient for epidural treatment which can be adjusted for a wide variety of patient sizes and treatment table configurations.

To attain this, the present invention generally comprises a base assembly a stanchion extending upwardly from the base assembly, a pair of adjustable foot supports positioned on either side of the stanchion, and pair of adjustable arm supports positioned on either side of the stanchion, a torso rest member positionable with respect to the stanchion, and may further comprise a motor and control assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the independent adjustability of the foot supports, arm supports, and torso support, allowing the present invention to be used with a broad range of patients and treatment tables.

Another significant advantage of the present invention is its ability to provide stable support for the patient without the need of an additional healthcare provider.

Still another significant advantage of the present invention is the motorized control of the vertical adjustment of both the foot support and torso supports, not only providing for faster adjustment, but also reducing the potential for injury for the healthcare providers.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
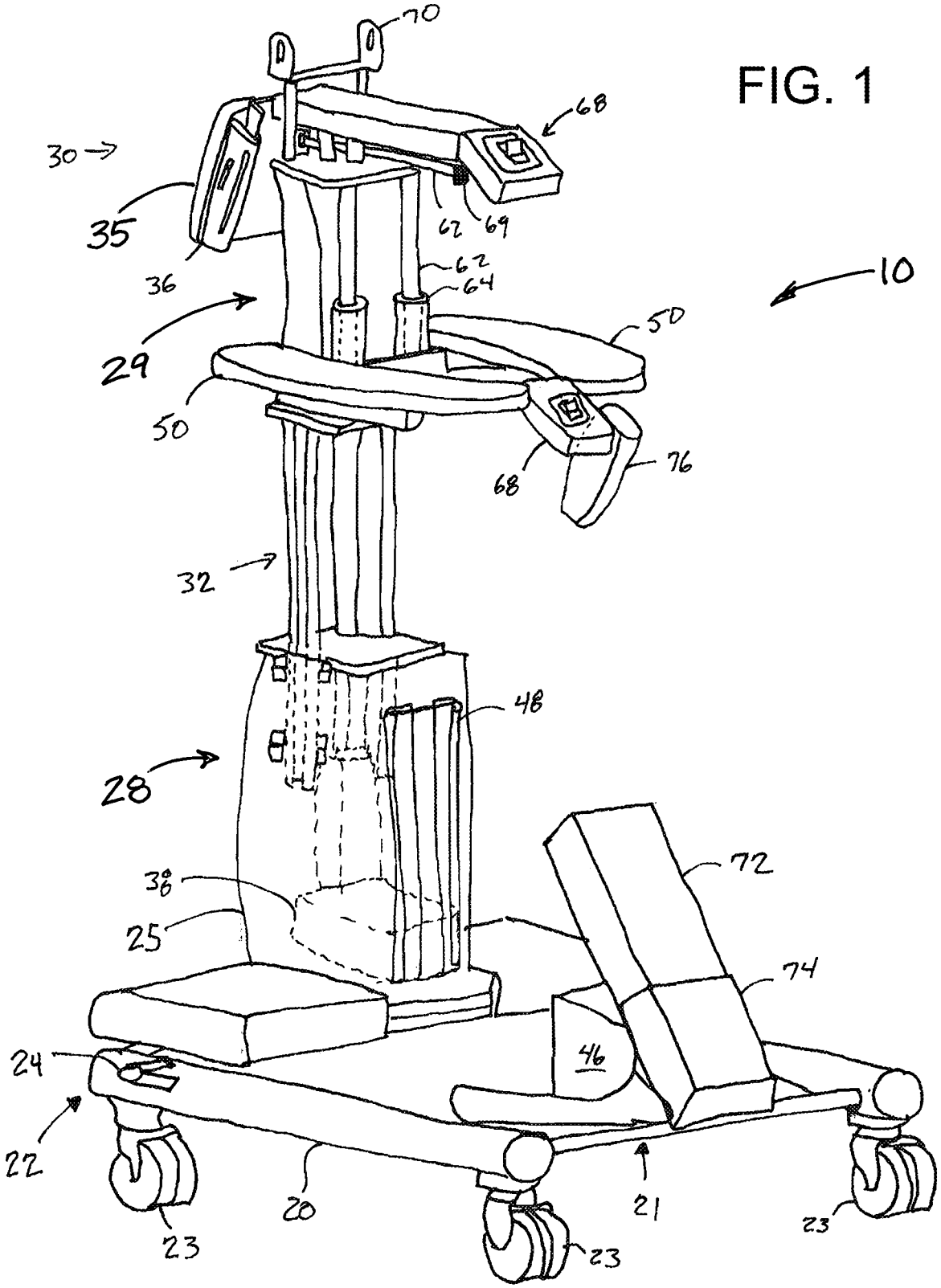
FIG. 1 is a schematic isometric view of a new epidural patient positioning system according to the present invention showing the foot support assembly in a lowered position relative to the base assembly and the torso support assembly in a retracted position relative to the stanchion.

With reference now to the drawings, and in particular to FIGS. 1 through 4 thereof, a new epidural patient positioning system embodying the principles and concepts of the present invention and generally designated by the reference numeral 10 will be described.

As best illustrated in FIGS. 1 through 4, the epidural patient positioning system 10 generally comprises a base assembly 20 having a front end 21 and a back end 22, a vertical assembly or stanchion 25 operationally coupled to the back end 22 of the base assembly 20 and extending upwardly from the base assembly 20, and a torso support or rest assembly 30 operationally coupled to the vertical assembly 25 adjacent to a top end 26 of the vertical assembly 25. A stanchion axis 27 is substantially vertically oriented and generally centered on the stanchion 25 (see FIG. 2).

The present invention preferably includes a pair of foot support assemblies each defining a foot support surface on which the patient may rest his or her foot. Each of the foot support assemblies may include a foot tray assembly 40 operationally coupled to the base assembly 20 and having a foot support surface thereon. Preferably, each one of the foot tray assemblies 40 is positioned adjacent to an associated side of the vertical assembly 25.

In at least one preferred embodiment, the foot support assemblies also include a pair of lifting means 42 with each of the foot support assemblies including one of the lifting means. Each one of the pair of lifting means 42 may include a first end which is operationally coupled to the base assembly 20 and a second end which is operationally coupled to an associated one of the pair of foot tray assembles 40. The pair of lifting means 42 selectively adjust the vertical position of the pair of foot tray assemblies 40 relative to the base assembly 20. The present invention contemplates the lifting means 42 being implemented as a scissor lift, pneumatic lift, screw lift, cable lift, hydraulic lift or other suitable system.

In one preferred embodiment each one of the pair of lifting means 42 is a scissor jack 44 operationally coupled to a motor for raising and lowering the associated foot tray assembly 40. Each scissor jack 44 is capable of elevating the foot tray assembly 40 to a desired height above the base assembly 20 selected by a user. Preferably, the scissor jack 44 provides at approximately 9 inches of adjustability.

In a further embodiment, the present invention also includes at least one guide assembly 48 positioned substantially on the vertical assembly 25 and operationally coupled to the pair of foot tray assemblies 40.

In still a further embodiment, the vertical assembly or stanchion of the present invention may have a lower portion 28 extending upwardly from the base assembly and an upper portion 29 extending upwardly from the lower portion and being vertically movable with respect to the lower portion. The vertical assembly may include a torso support assembly height adjustment means 32 for selectively positioning a height of the torso support assembly 30 relative to the base assembly 20 by moving the upper portion of the vertical assembly (on which the torso support is mounted) with respect to the lower portion of the vertical assembly mounted on the base assembly. The present invention contemplates the torso support assembly height adjustment means 32 being implemented as a scissor lift, pneumatic lift, screw lift, cable lift, hydraulic lift, slide/gear lift, or other suitable system.

Figure 2:
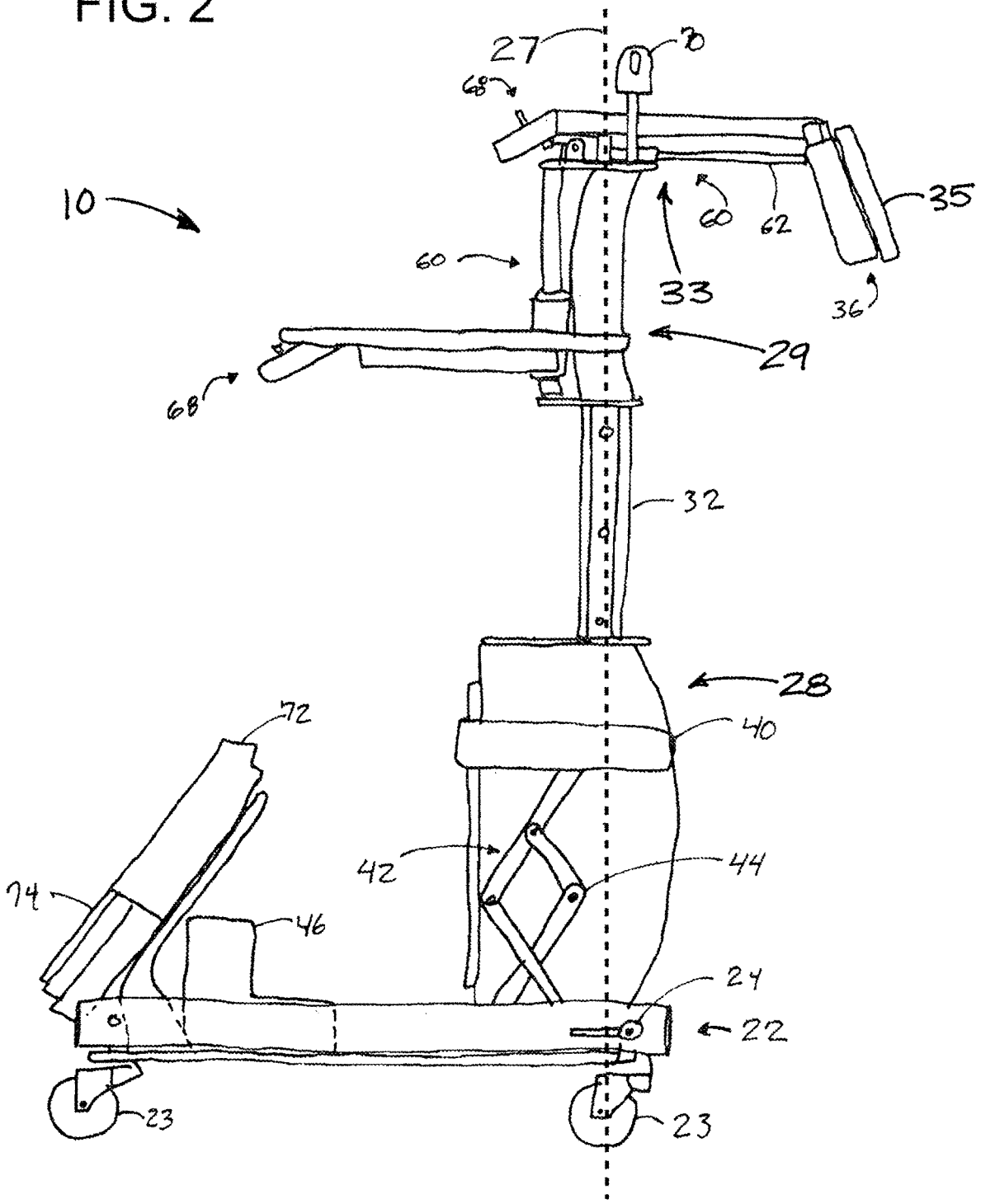
FIG. 2 is a schematic side view of the present invention with the foot support assemblies elevated into a raised position relative to the base assembly and the torso support assembly in an extended position relative to the stanchion.

Preferably, a torso support member 34 with a torso rest surface 35 is operationally coupled to the torso support assembly 30 and is positionable laterally relative to the vertical assembly 25 between a retracted position (see, e.g. FIG. 1) and an extended position (see, e.g., FIG. 2). In the retracted position, as shown for example in FIG. 1, the torso rest surface is relatively closer to the stanchion and in the extended position, as shown for example in FIG. 2, the torso rest surface is relatively further from the stanchion. The torso support member 34 may have approximately six inches of lateral adjustability. This adjustability may be accommodated by using a positioning slide and lock assembly 60 operationally coupled between the torso support member 34 and the torso support assembly 30.

In at least one preferred embodiment the torso support member 34 includes a support pad mounting assembly 36 which is vertically positionable such that a height to the support pad mounting assembly 36 is adjustable relative to the base assembly 20.

In still a further embodiment, the present invention also includes a head cushion mounting assembly 70 positioned along a top end 26 of the vertical assembly 25. The head cushion mounting assembly 70 may be pivoted throughout at least a forty-five degree arc allowing the patients head to be optimally positioned.

In still a further preferred embodiment, the present invention also includes a pair of arm rest assemblies 50 operationally coupled to the vertical assembly 25 and each positioned adjacent to an associated side of the vertical assembly 25 and each one of the arm support assemblies extending forward of the vertical assembly 25. Preferably, each one of the pair of arm rest assemblies 50 is vertically positionable along a portion of the vertical assembly 25.

In yet a further preferred embodiment, the pair of arm rest assemblies 50 are vertically positioned using at least one slide rod and spring lock assembly 60 for selectively positioning the pair of arm rest assemblies 50 along a portion of the vertical assembly 25. More preferably a pair of slide rod and spring lock assemblies 60 is used. Generally, the arm rest assemblies 50 are vertically adjustable over approximately a six inch range.

Figure 3:
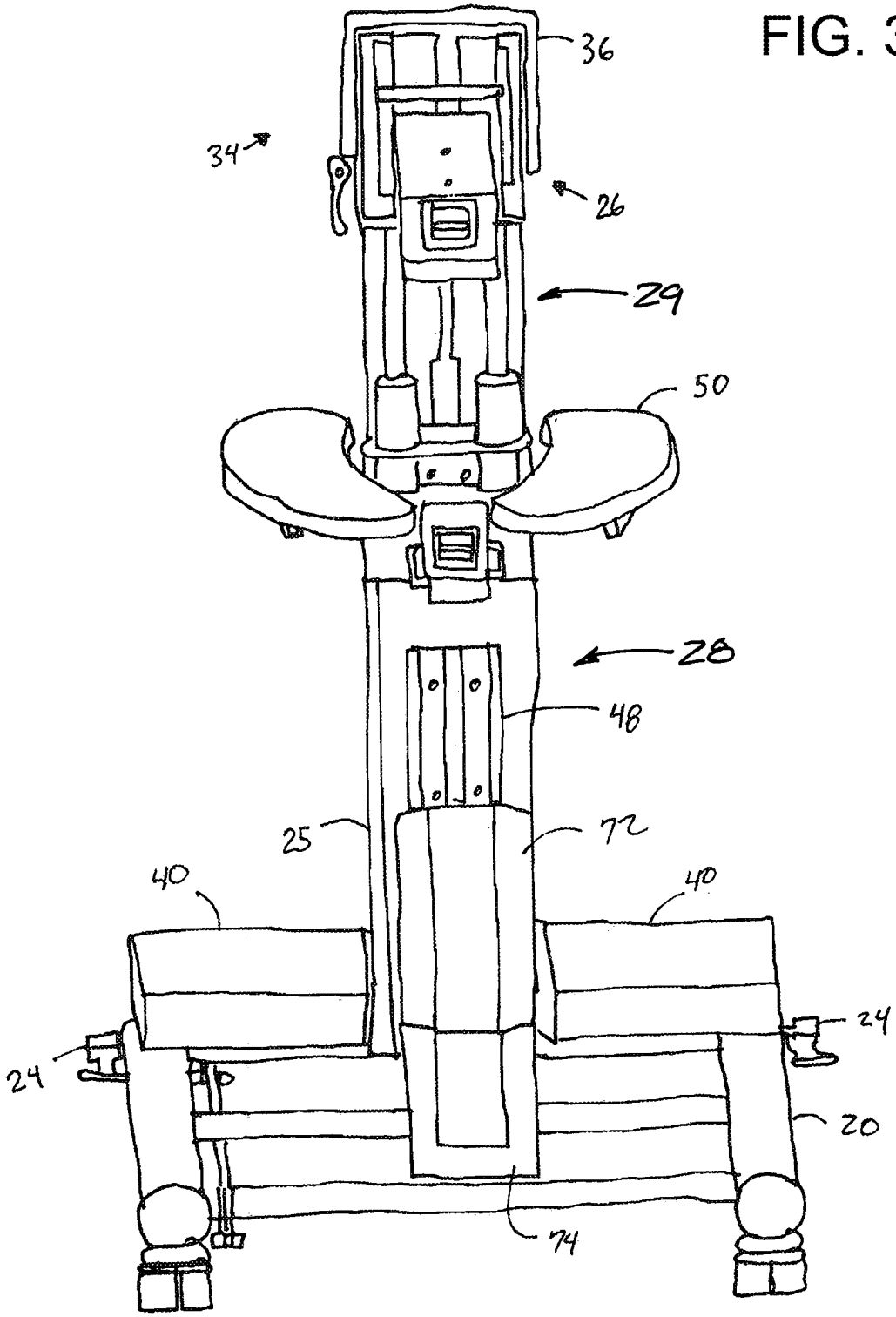
FIG. 3 is a schematic front view of the present invention.
Figure 4:
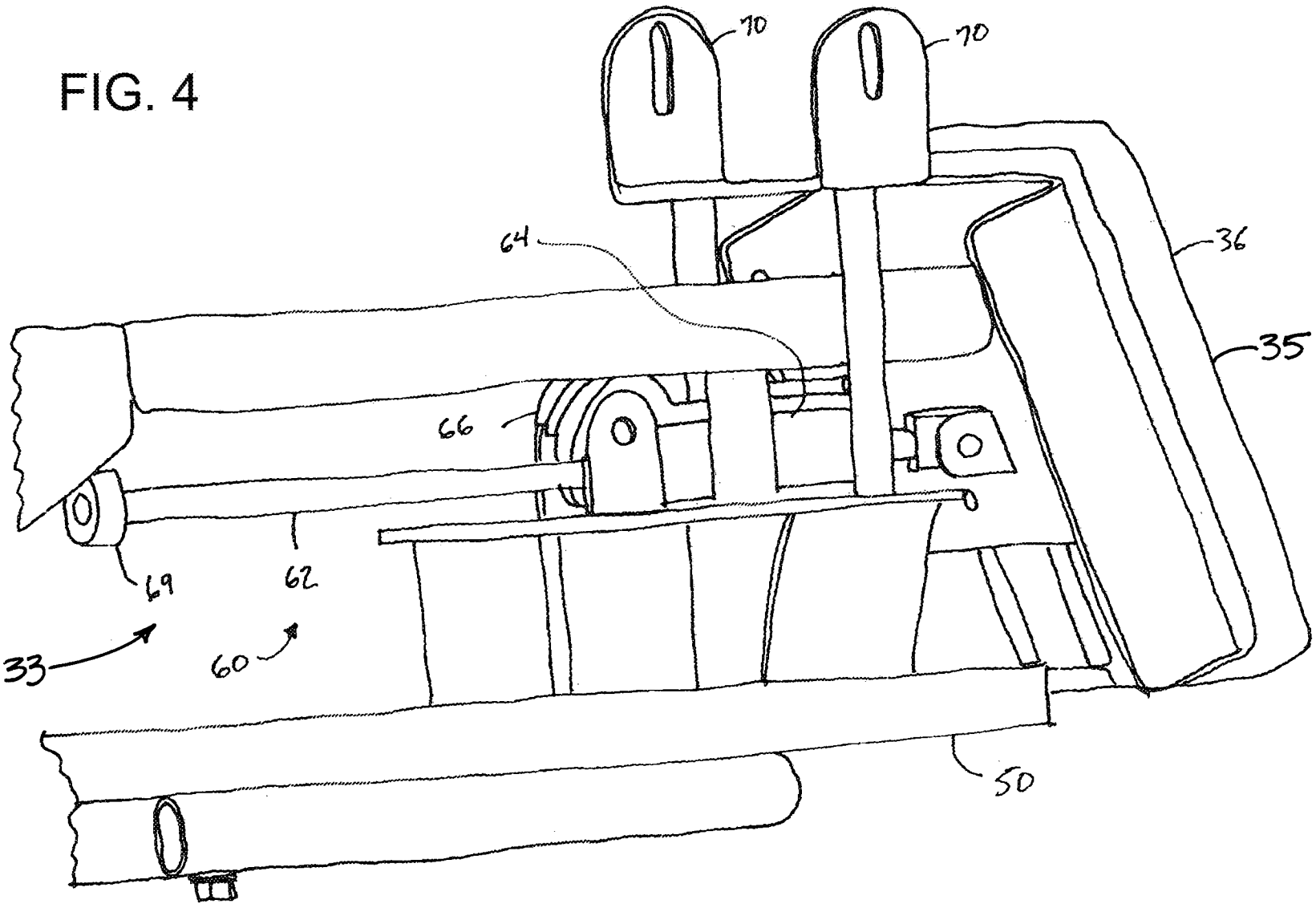
FIG. 4 is a schematic side view of the Rod/Spring Lock assembly of the present invention.
Figure 5:
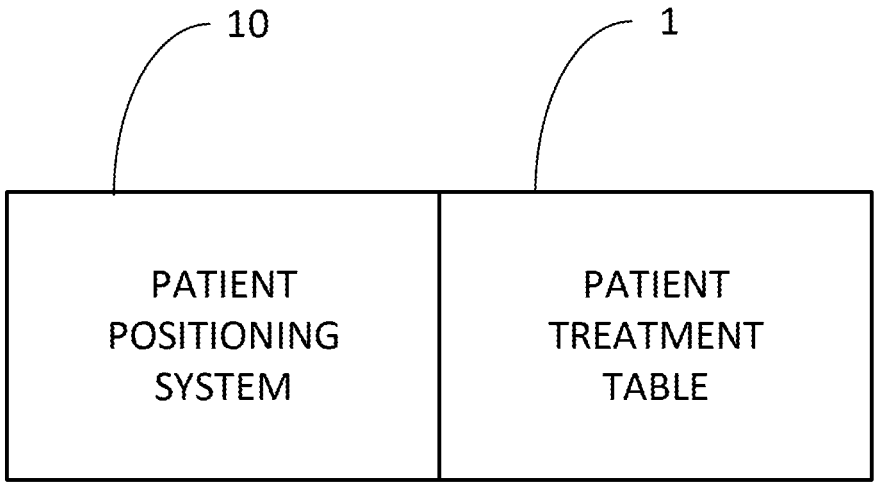
FIG. 5 is a schematic diagram of the patient positioning system with respect to a patient treatment table.

A slide rod and spring lock assembly 60 is illustratively utilized to provide adjustability of the arm rest assemblies 50 (as best shown in FIGS. 1 through 3) and is also illustratively utilized as a torso rest adjustment assembly 33 to adjust the position of the torso rest member 34 with respect to the vertical assembly or stanchion (as best shown in FIGS. 1, 2, and 4 of the drawings). The slide rod and spring lock assembly 60 may be described in a variety of manners. As an illustrative example, and not for purposes of limitation, the slide rod and spring lock assembly 60 may be considered substantially as shown in FIG. 4 for adjusting the torso rest member. A rod member 62 is coupled to the item to be adjusted at the proximal end of the rod member 62. A guide member 64 is secured to a stationary portion of the present invention and slideably receives the rod member 62. A spring loaded friction brake 66 abuts at least a portion of the surface of a length of the rod member 62 to inhibit movement of the rod member 62 relative to the guide member 64. A spring release 68 is coupled to the spring loaded friction brake 66 for temporarily releasing the friction brake and allowing the rod member 62 to move relative to the guide member 64. A rod stop 69 is positioned on the distal end of the rod member 62 to inhibit the rod member 62 from being pulled through the guide member 64 and being removed from the device as a whole.

Preferably, the present invention also includes a first motor assembly 46, a second motor assembly 38, a battery member 72, and a control assembly 74. Generally, the first motor assembly 46 is operationally coupled to the foot tray assembly lifting means 42. Similarly, the second motor assembly 38 is operationally coupled to the torso assembly height adjusting means 32 The battery member 72 provides power for the first motor assembly 46, second motor assembly 38, and control assembly 74.

The control assembly 74 is typically operationally coupled to the first motor assembly 46 for selectively controlling the operation of the first motor assembly 46 and to the second motor assembly 38 for selectively controlling the operation of the second motor assembly 38.

In a preferred embodiment, the present invention also includes a remote control unit 76 operationally coupled to the control assembly 74 for selectively controlling the operation of the first motor assembly 46 and the second motor assembly 38. The remote control unit 76 may be wired to the control unit 74 or may be wirelessly coupled to the control unit 74.

The present invention also contemplates the use of a plurality of caster assemblies 23 positioned on a bottom of the base assembly 20 facilitate moving the device 10 relative to the treatment table 1 or between rooms. Preferably, a locking member 24 is used to selectively lock each one of the plurality of caster assemblies 23 in a fixed position.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An epidural patient positioning system for engaging portions of a body of a patient in a sitting position on a patient treatment table, the system comprising:

a base assembly for resting upon a floor and being elongated in a longitudinal direction between a front end and a back end;

a stanchion mounted on and extending upwardly from the base assembly, the stanchion having a top end and a bottom end mounted on the base assembly, the stanchion defining a substantially vertical stanchion axis between the top and bottom ends thereof, a front side of the stanchion being defined on one side of the stanchion axis and a back side being defined on an opposite side of the stanchion axis;

a torso rest assembly coupled to the stanchion toward the top end of the stanchion, the torso rest assembly having a torso rest surface;

a pair of foot support assemblies located on opposite lateral sides of the stanchion and each having a foot support surface on which at least a portion of one of the patient's feet is restable, each of the foot support assemblies being adjustable to adjust a vertical position of the foot support surface relative to the base assembly; and a pair of arm support assemblies located on opposite lateral sides of the stanchion and each having an arm support surface on which at least a portion of one of the patient's arms is restable, each of the arm support assemblies being adjustable to adjust a vertical position of the arm support surface relative to the base assembly;

wherein the torso rest assembly is positioned on the back side of the stanchion axis of the stanchion with the torso rest surface oriented away from the stanchion to permit positioning of the torso rest assembly over a portion of the patient treatment table;

wherein substantially an entirety of the base assembly is positioned on the front side of the stanchion axis of the stanchion to position the base assembly away from the patient treatment table when the torso rest assembly is positioned over a portion of the patient treatment table; and wherein the torso rest assembly is the backward-most extending element of the system in the horizontal direction to facilitate the positioning of the torso rest assembly close to a patient in a sitting position on the patient treatment table.

* * * * *